US010815651B2

(12) United States Patent
Reyes, Jr.

(10) Patent No.: US 10,815,651 B2
(45) Date of Patent: Oct. 27, 2020

(54) SYSTEM AND METHOD FOR PIPE STABILIZATION

(71) Applicant: Antonio Reyes, Jr., Northbrook, IL (US)

(72) Inventor: Antonio Reyes, Jr., Northbrook, IL (US)

( * ) Notice: Subject to any disclaimer, the term of this patent is extended or adjusted under 35 U.S.C. 154(b) by 85 days.

(21) Appl. No.: 16/254,104

(22) Filed: Jan. 22, 2019

(65) Prior Publication Data

US 2020/0232196 A1 Jul. 23, 2020

(51) Int. Cl.
*E03C 1/042* (2006.01)

(52) U.S. Cl.
CPC ..... *E03C 1/042* (2013.01); *Y10T 137/6977* (2015.04)

(58) Field of Classification Search
CPC ..... E03C 1/042; Y10T 137/6977
See application file for complete search history.

(56) References Cited

U.S. PATENT DOCUMENTS 5,275,199 A * 1/1994 Howell ..... E03C 1/042 137/360
5,911,392 A * 6/1999 Greenslate ..... A62C 35/68 248/205.3
9,717,522 B2 * 8/2017 Albrecht ..... A61B 17/3496
2006/0196549 A1 * 9/2006 Roje ..... E03C 1/041 137/359
2010/0116359 A1 * 5/2010 Ball ..... E04G 15/061 137/360

* cited by examiner

*Primary Examiner* — Jessica Cahill
*Assistant Examiner* — Patrick C Williams
(74) *Attorney, Agent, or Firm* — Benjamin D. Rotman; Rosenbaum IP, P.C.

(57) ABSTRACT

The present invention is a flange device, system, and method configured to securing and stabilizing a water supply pipe. The system includes a security wall having an inner surface, an outer surface and a water supply pipe opening; a water supply pipe traversing through the security wall water supply pipe opening, the water supply pipe having a proximal portion projecting away from the security wall inner surface and a distal portion projecting away from the security wall outer surface; a security flange concentrically disposed around the distal portion of the water supply pipe and abutting against the security wall outer surface; and a system coupling mechanism configured to couple the security flange through the water supply pipe opening to the water supply pipe, the coupling mechanism further configured to hold the security flange in compression against the security wall outer surface and hold the water supply pipe in tension.

10 Claims, 2 Drawing Sheets

SYSTEM AND METHOD FOR PIPE STABILIZATION

BACKGROUND OF THE INVENTION

The present invention generally relates to securing and stabilizing water supply pipes. More particularly, the present invention relates to a device, system, and method configured to a secure a water supply pipe for a shower or faucet through the decorative or utility wall from which the water supply pipe protrudes.

A common problem in homes and commercial buildings alike is that the water supply pipes leading to the shower, sink, or additional faucet may not be properly secured upon installation, or naturally loosen over time. If theses pipes are not properly secured, the pipes may begin to vibrate and knock against each other or other surfaces behind the wall. Additional sources of instability and shaking or vibrating in water supply pipes may include faucet valves wearing out over time as well as water pressure fluctuations or the presence of air in the pipes. Over time, the constant movement adds stresses to the pipes causing additional fittings to come loose and causing the water supply pipes to leak. If the pipe leaks behind the wall, the leak may cause substantial damage to the drywall, supporting structures, or may even result in mold.

Fixing an insecure pipe or leak results in costly repairs that require a plumber to rip out the existing drywall, decorative tile, or cabinetry to access and patch, replace, or re-secure the existing water supply pipe and then may require a carpenter or mason to replace drywall or stone.

Pipes protruding from walls into living spaces, such as water supply pipes for consumer sinks or showers typically have decorative flanges concentrically disposed around the water supply pipe that abut against the protrusion wall in order to hide unsightly holes in the drywall where the supply pipe protrudes from. These decorative flanges are caulked to the protrusion wall, securing the flange to the wall. The caulk acts to seal any gaps between flange and the wall and hold the flange in place. The use of the flange in the prior art is decorative to cover holes and functional to seal around the holes to prevent water from faucet or shower head from reentering the wall, but the flange is not configured to secure the pipe, or hold the pipe in tension.

The present invention address the issue of providing a water supply pipe additional security and stabilization as a preventative and protective measure to the shaking and vibrating that may occur due to the reasons described above by providing a security flange configured to hold the water supply pipe in tension to reduce movement and damper vibration.

SUMMARY OF THE INVENTION

The methods, systems, and devices are set forth in part in the description which follows, and in part will be obvious from the description, or can be learned by practice of the methods, devices, and systems. The advantages of the methods, devices, and systems will be realized and attained by means of the elements and combinations particularly pointed out in the appended claims. It is to be understood that both the foregoing general description and the following detailed description are exemplary and explanatory only and are not restrictive of the methods, devices, and systems, as claimed.

In a first embodiment of the system, the system comprises a security wall having an inner surface, an outer surface and a water supply pipe opening; a water supply pipe traversing through the security wall water supply pipe opening, the water supply pipe having a proximal portion projecting away from the security wall inner surface and a distal portion projecting away from the security wall outer surface; a security flange concentrically disposed around the distal portion of the water supply pipe and abutting against the security wall outer surface; and a coupling mechanism configured to couple the security flange through the water supply pipe opening to the water supply pipe, the coupling mechanism further configured to hold the water supply the security flange in compression against the security wall outer surface and hold the water supply pipe in tension.

In one embodiment the security flange may comprise an annular shape having a security flange water supply pipe opening and a coupling mechanism opening. The security flange may comprise a flat bottom surface configured to abut against a water supply pipe wall and a top surface. In some embodiments, the top surface may also be flat, while in other embodiments the top surface may be decorative or stylized. The security flange may comprise common plumbing materials such as metal or plastic.

In some embodiments, the security flange may further comprise a compressible seal disposed along the bottom surface of the security flange. The compressible seal is configured to provide a water tight seal between the security flange and the security wall.

In some embodiments, caulk or adhesive may be applied around the perimeter of the security flange or the security flange water supply pipe opening to further reduce flange movement and to provide additional water sealing.

In some embodiments the coupling mechanism may comprise a cable tie having a ratchet member at a proximal end and an elongated portion with an integrated gear rack spanning the longitudinal axis of the cable tie. In these embodiments, the cable tie is configured to be concentrically disposed around the distal end of the water supply pipe wherein the elongated portion is inserted into the ratchet member forming a loop around the water supply pipe. The cable tie is then positioned through the security wall water supply pipe hole and the cable tie is fully ratcheted and tightened around the proximal end of the water supply pipe leaving the elongated member protruding through the security wall water supply pipe opening. The security flange is then disposed over the water supply pipe at the distal end of the water supply pipe, and the elongated member is fully ratcheted and tightened through the security flange coupling mechanism holding the water supply pipe in tension and holding the security flange compressed against the outer surface of the security wall.

In some embodiments the coupling mechanism may comprise a hose clamp having a ratchet member or screw tightening member at a proximal end and an elongated portion with integrated slots spanning the longitudinal axis of the hose clamp. In these embodiments, the hose clamp is configured to be concentrically disposed around the distal end of the water supply pipe wherein the elongated portion is inserted into the ratchet member forming a loop around the water supply pipe. The hose clamp is then positioned through the security wall water supply pipe hole and the hose clamp is fully ratcheted and tightened around the proximal end of the water supply pipe leaving the elongated member protruding through the security wall water supply pipe opening. The security flange is then disposed over the water supply pipe at the distal end of the water supply pipe, and the elongated member is fully ratcheted and tightened through the security flange coupling mechanism holding the water supply pipe in tension and holding the security flange compressed against the outer surface of the security wall.

BRIEF DESCRIPTION OF THE DRAWINGS

In the accompanying figures, like elements are identified by like reference numerals among the several preferred embodiments of the present invention.

DETAILED DESCRIPTION OF THE PREFERRED EMBODIMENTS

The foregoing and other features and advantages of the invention will become more apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Figure 1:
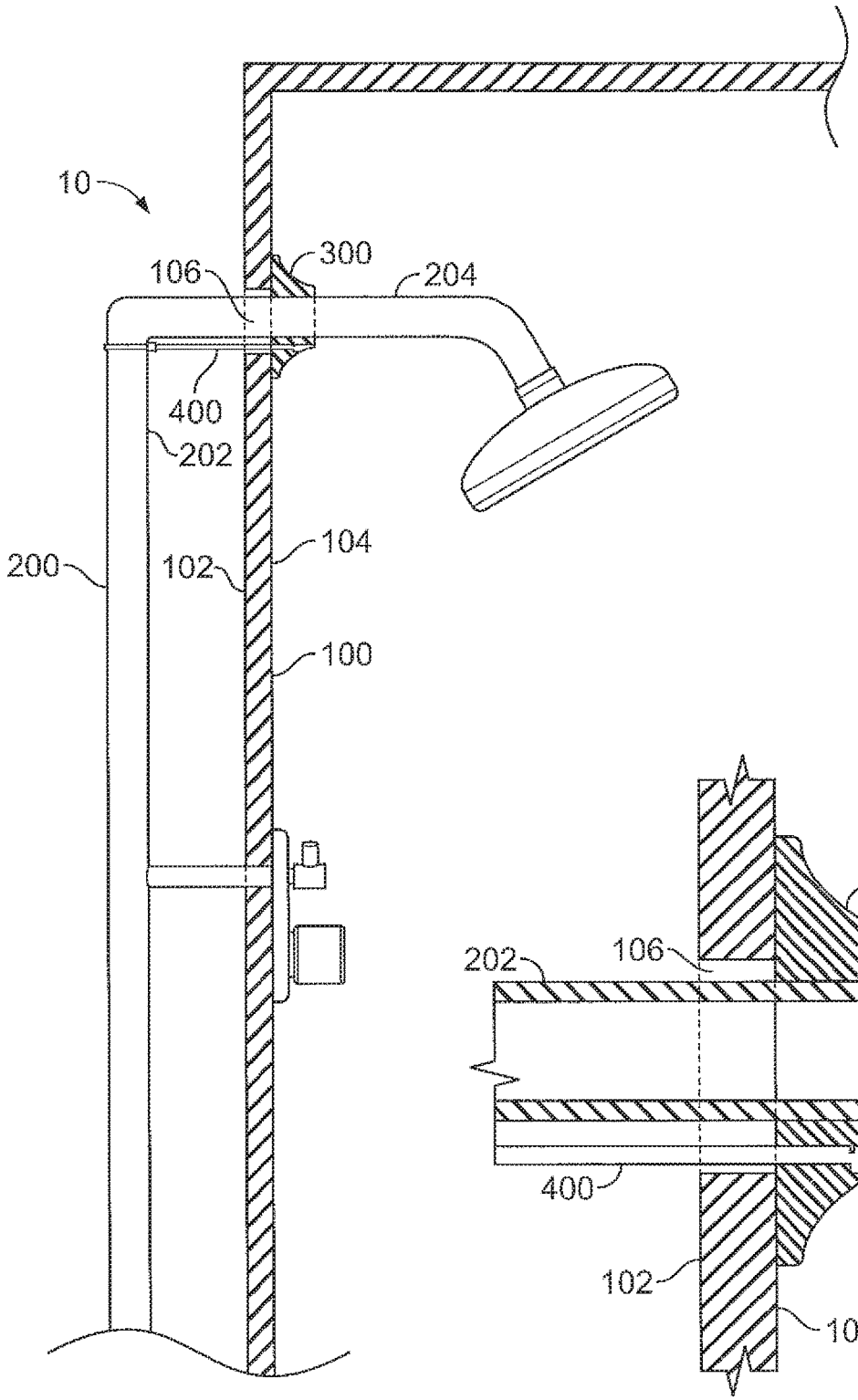
FIG. 1 represents a first embodiment of the system.

FIG. 1 show elements of a first embodiment of the system 10. As show in FIG. 1 the system comprises a security wall 100, a water supply pipe 200, a security flange 300, and a coupling mechanism 400. The security wall 100 comprises a security wall inner surface 102, a security wall outer surface 104, and a security wall water supply pipe opening 106. The security wall 100, in some embodiments may comprise dry-wall (with or without a decorative veneer or tile) mounted and hung to standard framing (not-shown) or other common building materials including but not limited to brick or concrete. The security wall 104 like most buildings is configured to provide an aesthetic barrier between the building framing, insulation, conduits, and pipes and the users of the room itself.

The water supply pipe 200 comprises a water supply pipe proximal portion 202 and a water supply pipe distal portion 204. As shown in FIG. 1, the water supply pipe proximal portion 202 is concealed behind the security wall inner surface 102, while the water supply pipe distal portion 204, protrudes through the security wall water supply pipe opening 106. In some embodiments the water supply pipe 200 is configured to deliver water to a shower while in other embodiments the water supply pipe 200 is configured to deliver water to a bath or sink. The water supply pipe 200 may comprise any standard material used in the plumbing industry including but not limited to copper, chromed copper, galvanized iron, Chlorinated Poly-Vinyl Chloride (CPVC), or Cross-linked Polyethylene (PEX).

Figure 2:
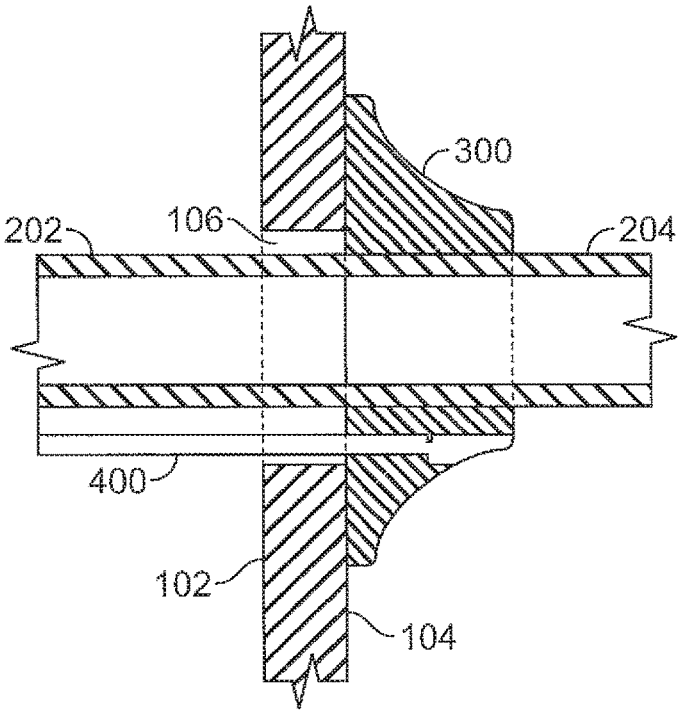
FIG. 2 represents an enlarged system assembly.
Figure 3:
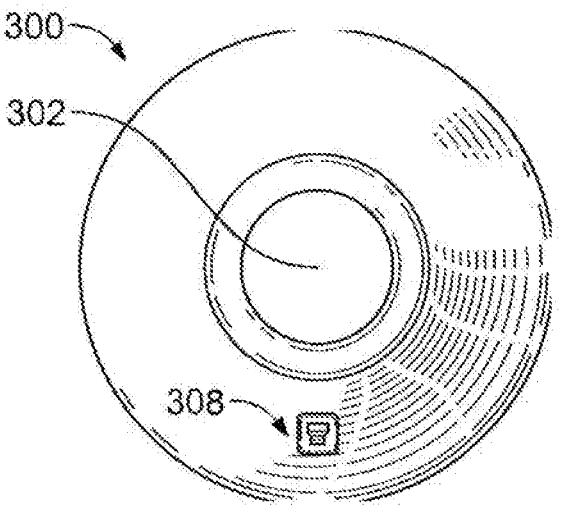
FIG. 3 represents a front view of the security flange.
Figure 4:
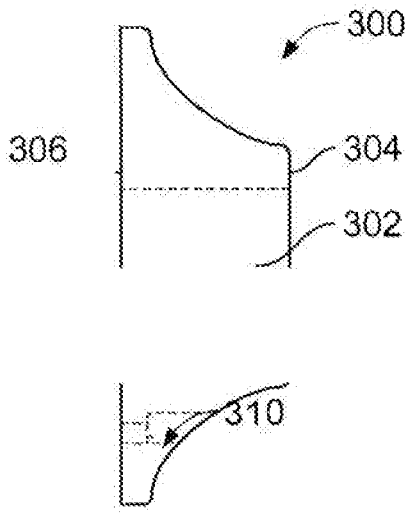
FIG. 4 represents a side view of the security flange.

As shown in FIG. 1 and additionally detailed in FIGS. 2-4, the system additionally comprises a security flange 300. The security flange 300 primarily comprises an annular body member having a security flange water supply pipe opening 302, a top security flange surface 304, a security flange bottom surface 306, and a security flange coupling mechanism 308 embedded, molded, machined, or formed into the security flange top surface 304 or security flange bottom surface 306. The security flange 300 may be comprised of a metal, plastic, or composite thereof. The security flange 300 is disposed over water supply pipe distal portion 204 wherein the water supply pipe distal portion 204 passes through the security flange water supply pipe opening 302, and the security flange bottom surface 306 is positioned against the security wall outer surface 104. The security flange 300 is further coupled to the water supply pipe proximal portion 202 through the security flange coupling mechanism 308 and the system coupling mechanism 400. In some embodiments, the security flange 300 may further comprise a compressible seal (not shown) disposed along the bottom surface 306 of the security flange 300. The compressible seal is configured to provide a water tight seal between the security flange 300 and the security wall 104.

Figure 5A:
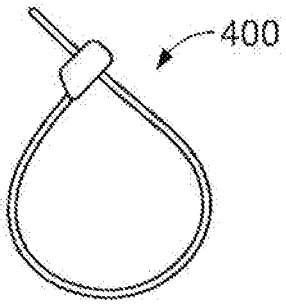
FIGS. 5A and 5B represent an embodiment of the coupling mechanism.
Figure 5B:
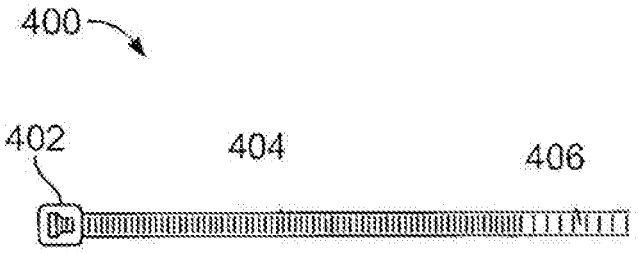

As shown in FIGS. 5A and 5B the system coupling mechanism 400 is configured to couple the water supply pipe proximal portion 202 to the security flange 300 while holding the water supply pipe 200 in tension and compressing the security flange 300 against the security wall outer surface 104. In some embodiments the system coupling mechanism 400 may comprise a plastic or metal cable tie which a common fastener known by one of skill in the art. The system coupling mechanism 400 (or cable tie), comprises a ratcheting member 402 at a system coupling mechanism proximal end 401 and a system coupling mechanism elongated portion 404 having an integrated gear rack 406 spanning a longitudinal axis of the system coupling mechanism 400. In these embodiments, the security flange coupling mechanism 308 comprises a ratcheting mechanism or ratcheting receptacle 310 that is the same or similar to the ratcheting member 402 of the system coupling mechanism 400.

In operation, a method for securing the water supply pipe 200 to the security flange 300 through the security wall 100 may include the steps of providing a plumbing system 5 comprising a security wall 100 having a security wall inner surface 102, a security wall outer surface 104, and a water supply pipe opening 106, the plumbing system further comprising a water supply pipe 200 having a water supply pipe proximal portion 202 disposed behind the security wall inner surface 102, and a water supply distal portion 204 disposed through the security wall water supply pipe opening 106, and projecting from the security wall outer surface 104; providing a security flange 300 comprising a an annular body member having a security flange water supply pipe opening 302, a security flange bottom surface 306, a top security flange surface 304, and a security flange coupling mechanism 308 embedded into the security flange top surface 304 or security flange bottom surface 306; providing a coupling mechanism comprising a ratcheting member 402 at a system coupling mechanism proximal end 401 and a system coupling mechanism elongated portion 404 having an integrated gear rack 406 spanning a longitudinal axis of the system coupling mechanism 400; positioning the system coupling mechanism elongated portion 404 around the water supply pipe distal portion 204 and inserting the system coupling mechanism elongated portion 404 into the ratcheting member 402 forming a partially ratcheted closed loop 408; translating the partially ratcheted closed loop 408 along the water supply pipe 200 through the security wall water supply pipe opening 106 to the water supply pipe proximal portion 202; ratcheting the partially ratcheted closed loop 408 until the partially ratcheted closed loop 408 has a an inner circumference approximately equal to an outer circumference of the water supply pipe 200; feeding the system coupling mechanism elongated portion 404 back through the security wall water supply pipe opening 106; disposing the security flange 300 over the water supply pipe 200 and feeding the system coupling mechanism elongated portion 404 through the security flange coupling mechanism 308 until the security flange bottom surface 306 is flush with the security wall outer surface 104 and held in compression against the security wall 200.

One of skill in the art would recognize that the steps may be completed out of the above stated order to complete the task of securing the security flange 300 to the water supply pipe 200. For example in one embodiment, the step of securing the system coupling mechanism 400 to the water supply pipe proximal portion 202 may be completed before the security wall 100 is even erected. Another non-limiting example may include disposing the security flange 300 over the water supply pipe 200 before the step of placing the system coupling mechanism 400.

In some embodiments, caulk or adhesive may be applied around the perimeter of the security flange 300 or the security flange water supply pipe opening 302 to further reduce flange movement and to provide additional water sealing.

In some embodiments the system coupling mechanism 400 may comprise a hose clamp having a ratchet member or screw tightening member at a proximal end and an elongated portion with integrated slots spanning the longitudinal axis of the hose clamp. While in other embodiments, the system coupling mechanism 400 may comprise a belt having a clasping or clamping member (not shown). In these embodiments, the clasping member could secure the belt/elongated member at various intervals, or the clamping member could clamp down anywhere on the belt. In embodiments using the belt style coupling member, the security flange coupling mechanism may be a clasp or clamp as well.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

The invention claimed is:

1. A system for securing a water supply pipe comprising:

a security wall having an inner surface, an outer surface and a water supply pipe opening;

the water supply pipe traversing through the security wall water supply pipe opening, the water supply pipe having a proximal portion projecting away from the security wall inner surface and a distal portion projecting away from the security wall outer surface;

a security flange concentrically disposed around the distal portion of the water supply pipe and abutting against the security wall outer surface, the security flange comprising a security flange water supply pipe opening, a security flange bottom surface, a top security flange surface, and a security flange coupling mechanism having a ratcheting receptacle embedded into the security flange top surface or security flange bottom surface;

a system coupling mechanism configured to couple the security flange through the water supply pipe opening to the water supply pipe, the coupling mechanism further configured to hold the security flange in compression against the security wall outer surface and hold the water supply pipe in tension, the system coupling mechanism comprising a system coupling mechanism proximal end having a ratcheting member and a system coupling mechanism elongated portion having an integrated gear rack spanning the system coupling mechanism elongated portion; and wherein the system coupling mechanism is secured around the water supply pipe proximal portion by inserting the system coupling mechanism elongated portion through the ratcheting member and the system coupling mechanism is secured to the security flange by inserting the elongated portion through the ratcheting receptacle.

2. The system of claim 1 wherein the security flange comprises an annular body member.

3. The system of claim 1 further comprising:

caulk or adhesive along a perimeter of the security flange bottom surface and the security wall outer surface; or caulk or adhesive along the security flange water supply pipe opening and water supply pipe; or a compressible seal disposed on the security flange bottom surface.

4. A method for securing the water supply pipe comprising the steps of:

providing a plumbing system comprising a security wall having a security wall inner surface, a security wall outer surface, and a water supply pipe opening, the plumbing system further comprising the water supply pipe having a water supply pipe proximal portion disposed behind the security wall inner surface, and a water supply distal portion disposed through the security wall water supply pipe opening, and projecting from the security wall outer surface;

providing a security flange comprising an annular body member having a security flange water supply pipe opening, a flat security flange bottom surface, a top security flange surface, and a security flange coupling mechanism embedded into the security flange top surface or security flange bottom surface;

providing a system coupling mechanism wherein the system coupling mechanism comprises a ratcheting member at a system coupling mechanism proximal end and a system coupling mechanism elongated portion having an integrated gear rack spanning a longitudinal axis of the system coupling mechanism or wherein the system coupling mechanism comprises a clasp or clamp member at a system coupling mechanism proximal end and a system coupling mechanism elongated portion;

positioning and securing the system coupling mechanism on the water supply piped proximal portion and feeding the system coupling mechanism through the security wall water supply pipe opening such that at least a portion of the system coupling mechanism is projecting from the security wall outer surface by:

positioning the system coupling mechanism elongated portion around the water supply pipe distal portion and inserting the system coupling mechanism elongated portion into the ratcheting member forming a partially ratcheted closed loop, translating the partially ratcheted closed loop along the water supply pipe through the security wall water supply pipe opening to the water supply pipe proximal portion, ratcheting the partially ratcheted closed loop until the partially ratcheted closed loop has an inner circumference approximately equal to an outer circumference of the water supply pipe, and feeding the system coupling mechanism elongated portion back through the security wall water supply pipe opening; or positioning the system coupling mechanism elongated portion around the water supply pipe distal portion and inserting the system coupling mechanism elongated portion into the clasp or clamp member forming a partially clasped or clamped closed loop, translating the partially clasped or clamped closed loop along the water supply pipe through the security wall water supply pipe opening to the water supply pipe proximal portion, tightening the partially clasped or clamped closed loop until the partially ratcheted closed loop has a an inner circumference approximately equal to an outer circumference of the water supply pipe, and feeding the system coupling mechanism elongated portion back through the security wall water supply pipe opening; and disposing the security flange over the water supply pipe and feeding the system coupling mechanism through the security flange coupling mechanism until the security flange bottom surface is flush with the security wall outer surface and held in compression against the security wall.

5. The method for securing the water supply pipe of claim 4 wherein the step of disposing the security flange over the water supply pipe and feeding the system coupling mechanism through the security flange coupling mechanism further comprises ratcheting the elongated portion through the security flange coupling mechanism to tighten the security flange against the security wall.

6. The method for securing the water supply pipe of claim 5 further comprising the step of applying caulk or adhesive along a perimeter of the security flange and the security wall outer surface or applying caulk or adhesive along the security flange water supply pipe opening and water supply pipe.

7. The method for securing the water supply pipe of claim 4 wherein the step of disposing the security flange over the water supply pipe and feeding the system coupling mechanism through the security flange coupling mechanism further comprises clasping or clamping the elongated portion through the security flange coupling mechanism to tighten the security flange against the security wall.

8. The method for securing the water supply pipe of claim 4 further comprising the step of applying caulk or adhesive along a perimeter of the security flange and the security wall outer surface or applying caulk or adhesive along the security flange water supply pipe opening and water supply pipe.

9. A system for securing a water supply pipe comprising:

a security wall having an inner surface, an outer surface and a water supply pipe opening;

the water supply pipe traversing through the security wall water supply pipe opening, the water supply pipe having a proximal portion projecting away from the security wall inner surface and a distal portion projecting away from the security wall outer surface;

a security flange concentrically disposed around the distal portion of the water supply pipe and abutting against the security wall outer surface, the security flange comprising a security flange water supply pipe opening, a security flange bottom surface, a top security flange surface, and a security flange coupling mechanism having a security flange clasp embedded into the security flange top surface or security flange bottom surface;

a system coupling mechanism configured to couple the security flange through the water supply pipe opening to the water supply pipe, the coupling mechanism further configured to hold the security flange in compression against the security wall outer surface and hold the water supply pipe in tension, the system coupling mechanism comprising a system coupling mechanism proximal end having a system coupling mechanism clasp and a system coupling mechanism elongated portion; and wherein the system coupling mechanism is secured around the water supply pipe proximal portion by inserting the system coupling mechanism elongated portion through the system mechanism clasp or clamp and the system coupling mechanism is secured to the security flange by inserting the elongated portion through the security flange clasp or clamp.

10. The system of claim 9 further comprising:

caulk or adhesive along a perimeter of the security flange bottom surface and the security wall outer surface; or caulk or adhesive along the security flange water supply pipe opening and water supply pipe; or a compressible seal disposed on the security flange bottom surface.

* * * * *